United States Patent [19]

Heine

[11] 4,214,569

[45] Jul. 29, 1980

[54] FIREPLACE STOVE

[76] Inventor: Friedrich W. Heine, 577 Garfield, P.O. Box 10924, Eugene, Oreg. 97401

[21] Appl. No.: 894,554

[22] Filed: Apr. 10, 1978

[51] Int. Cl.[2] ..... F24C 1/14

[52] U.S. Cl. ..... 126/77; 126/193; 126/67; 126/109

[58] Field of Search ..... 126/66, 67, 62, 63, 126/64, 98, 119, 193, 15 R, 146, 109

[56] References Cited

U.S. PATENT DOCUMENTS

| | | | |
|---|---|---|---|
| 1,175,254 | 3/1916 | Gailey | 126/67 |
| 1,931,959 | 10/1933 | Holmes | 126/67 |
| 2,174,572 | 10/1939 | Esson | 126/67 |
| 3,080,862 | 3/1963 | Desgagne | 126/62 |
| 4,121,560 | 10/1978 | Knight | 126/67 |

FOREIGN PATENT DOCUMENTS

| | | | |
|---|---|---|---|
| 2282603 | 8/1974 | France | 126/66 |

*Primary Examiner*—Samuel Scott
*Assistant Examiner*—Wesley S. Ratliff, Jr.
*Attorney, Agent, or Firm*—Klarquist, Sparkman, Campbell, Leigh, Hall & Whinston

[57] ABSTRACT

The specification discloses a fireplace stove in which heat exchange tubes slope upwardly from a sloping rear wall to a sloping front wall of a polygonal body and are open at each end. A door is openable and/or removable from the body to form a fireplace. A door frame has a thermostat controlled damper at its top and outlets to the fire area near in the lower, side portions thereof. A baffle is spaced below the flue outlet and is aligned with the flue outlet.

6 Claims, 8 Drawing Figures

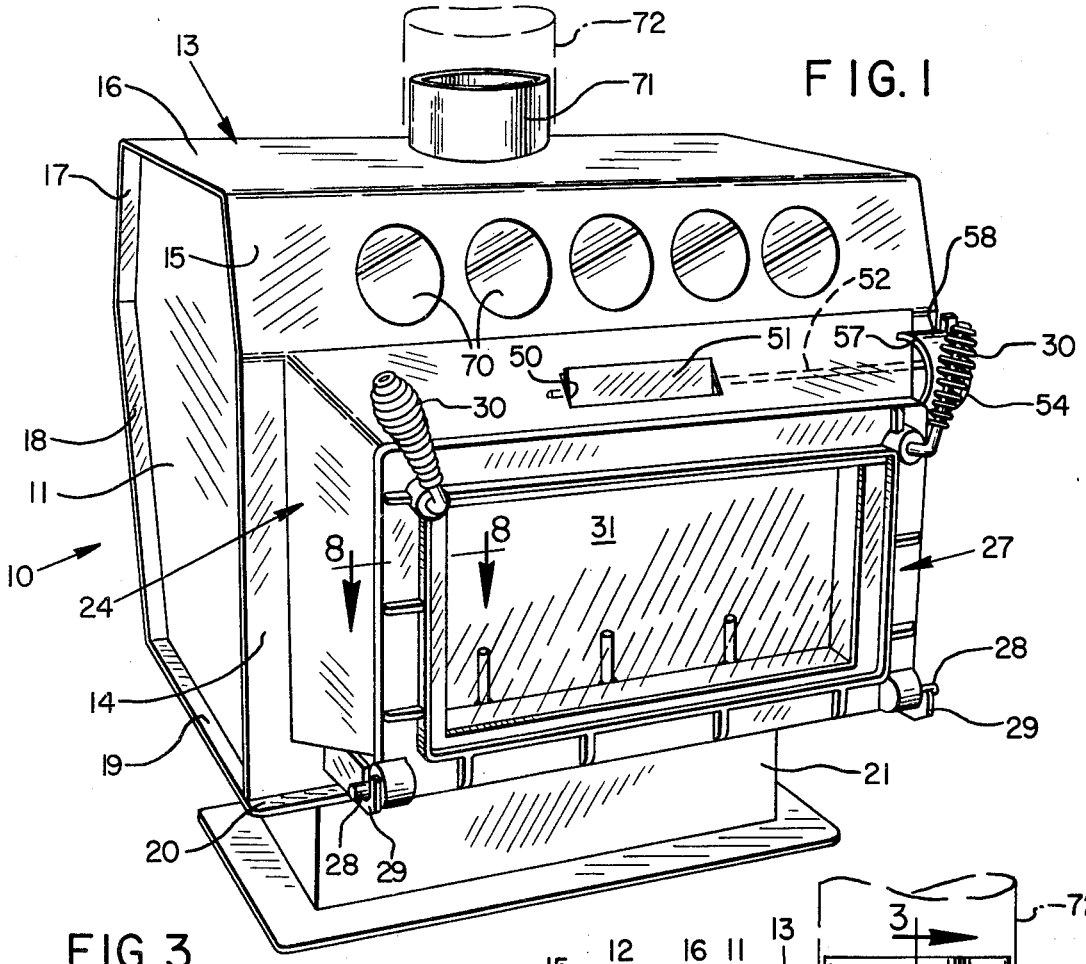
FIG. 1
FIG. 3
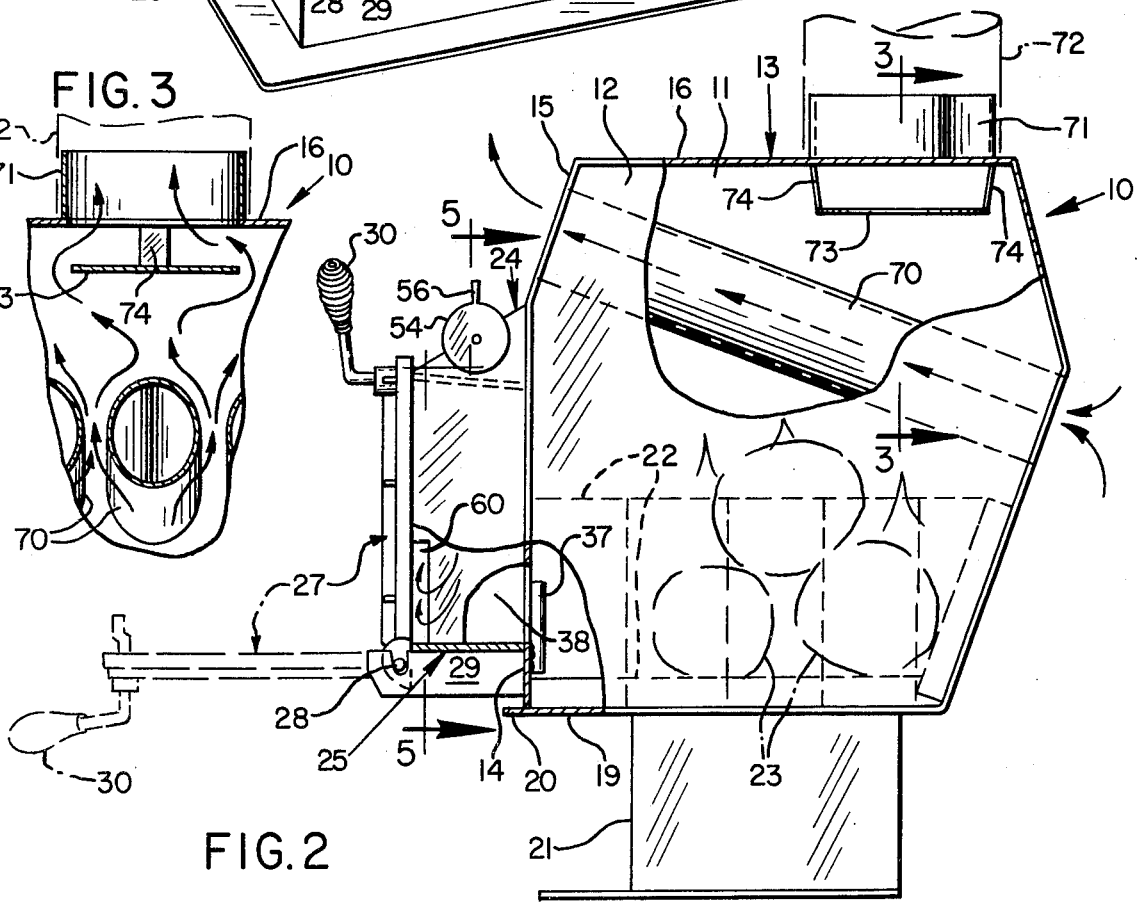
FIG. 2

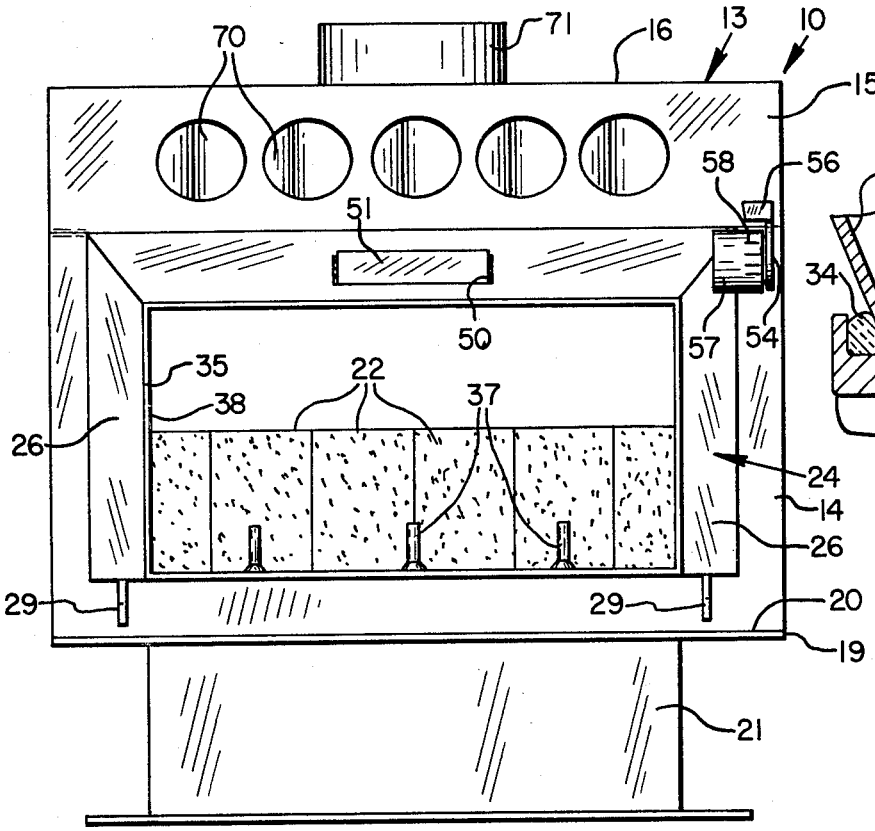
FIG. 4
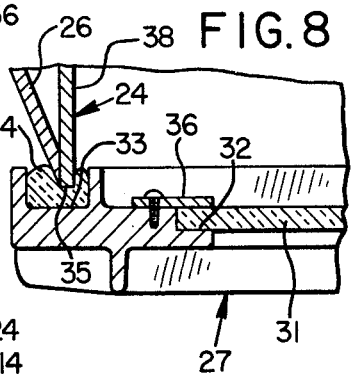
FIG. 8
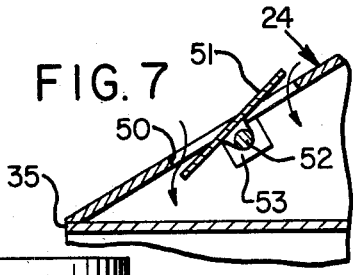
FIG. 7
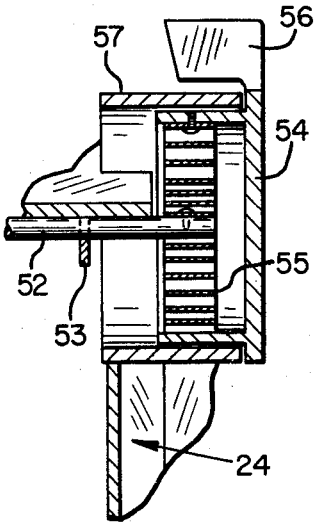
FIG. 6
FIG. 5
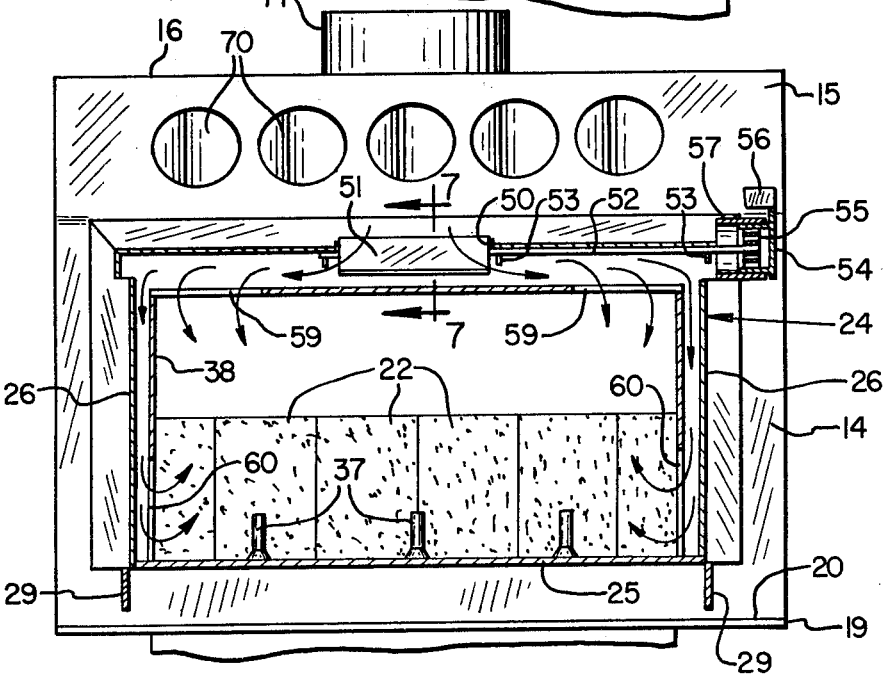

FIREPLACE STOVE

DESCRIPTION

This invention relates to an improved fireplace stove, and has for an object thereof the provision of a new and improved fireplace stove.

Another object of the invention is to provide a very efficient fireplace stove.

A further object of the invention is to provide a fireplace stove having heat exchange tubes extending upwardly through the upper portion of the stove body to a sloping front wall of the body.

Another object of the invention is to provide a fireplace stove having a door with a tubular frame having a damper controlled air inlet and outlets spaced therefrom and opening into the combustion portion of the stove.

IN THE DRAWINGS:

FIG. 1 is a perspective view of an improved fireplace stove forming one embodiment of the invention;

FIG. 2 is a vertical, sectional view of the stove of FIG. 1;

FIG. 3 is a fragmentary, vertical, sectional view taken along line 3—3 of FIG. 2;

FIG. 4 is a front, elevation view of the stove of FIG. 1;

FIG. 5 is a fragmentary, vertical, sectional view taken along line 5—5 of FIG. 2;

FIG. 6 is an enlarged, fragmentary, vertical, sectional view of a thermostat of the stove of FIG. 1;

FIG. 7 is an enlarged, fragmentary, vertical, sectional view taken along line 7—7 of FIG. 5; and, FIG. 8 is an enlarged, fragmentary, vertical, sectional view taken along line 8—8 of FIG. 1.

An improved fireplace stove forming one specific embodiment of the invention includes a sheet steel body 10 comprising end plates 11 and 12 welded to a polygonal sheet 13 having front sides 14 and 15, a top 16, rear sides 17 and 18 and a bottom 19 having a lip portion 20 extending beyond the lower front side 14, the bottom being welded to the lower edge of the side 14. The bottom also is secured to a pedestal type base 21. Firebricks 22 form a firepot for fuel pieces 23 of wood or coal. A U-shaped tubular door frame 24 is welded to the front side 14 as is a hearth plate 25 to which the lower ends of legs 26 of the door frame are welded. A door 27 has aligned pintles 28 supported by notched plates 29 welded to the hearth plate 25 and the door has latches 30 at its upper corners. A thick, tempered, heat resistant glass 31 is mounted in a dado groove 32 (FIG. 8) in the door. The door also has a U-shaped groove 33 receiving an asbestos door seal 34 (FIG. 8) adapted to seal against edge 35 of the door frame. Cleats 36 hold the glass in place. Bars 37 (FIG. 5) welded to the portion of the side 14 below opening 38 in the side 14 form log retainers.

The U-shaped door frame 24 (FIG. 7) is triangular in transverse cross-section and at its central, top portion has a rectangular air inlet 50 (FIGS. 5 and 7) adapted to be adjustably closed to a desired extent by a damper plate 51 welded to a rod 52 mounted rotatably in brackets 53 and extending into a thermostat cup 54 and secured to an inner end of a thermostatic coil 55 having its outer end fixed to the cup 54. The cup has a combined handle and indicator 56 and is rotatably adjustable in tube 57 welded to the door frame. The handle indicates on a scale 58 the adjustment of the thermostat. The door frame is heated by a fire in the stove and heats air entering the inlet 50 as the air is pulled by the draft along the tubular door and out of outlet openings 59 in the upper portion and outlet openings 60 in the lower portions of the legs of the door frame and into the combustion zone.

The heated gases of combustion travel up from the combustion zone past large area heat exchange tubes 70 to and through a stack tube 71 welded to the top 16 and are vented by a stovepipe 72. A baffle disc 73 is mounted on posts 74 in alignment with the stack tube 71 and spaced below the lower end of the stack tube. The tubes 70 are welded to and are perpendicular to upper front side 15 and lower rear side 18 and are open at both ends. Air from the space to be heated enters the lower righthand ends of the tubes 70, as viewed in FIG. 2, and travels by convertion upwardly and to the left as it is heated and flows into the room. As shown in FIGS. 1 and 3, the tubes 70 cover about two-thirds of the area extending across the space between the combustion zone and the stack tubes so that the gases flow therearound to heat the tubes and also prevent excessive draft.

What is claimed is:

1. In a fireplace stove, a body having a door opening, a tubular door frame of metal extending at least partially around the door opening, a door detachably secured to the door frame, the door frame having a draft inlet opening and a draft outlet opening spaced along the door frame from the inlet opening, and damper means for adjustably controlling flow of air through the door frame from the inlet opening to the outlet opening.

2. The fireplace stove of claim 1 wherein the draft inlet is at the top of the door frame and the outlet is near the bottom of the door frame.

3. The fireplace stove of claim 2 wherein the door frame has a tubular portion in the form of an inverted "U".

4. The fireplace stove of claim 2 including a damper plate, a rod supporting the damper plate and extending along the top of the tubular portion, a thermostatic coil attached to the rod, and manually adjustable means for adjusting the coil.

5. In a stove, a hollow body having a combustion chamber in the lower portion thereof and a stack opening in the upper portion thereof, a plurality of generally cylindrical heat exchange tubes open at both ends and extending completely through the body between the combustion chamber and the stack opening and sloping upwardly from the rear of the body to the front of the body, the tubes being parallel and lying side-by-side in a plane and spaced apart, the tubes acting as baffles and covering a substantial portion of the area between the combustion chamber and the stack opening, a doorway in the body, a door detachably secured to the doorway, and preheating draft tube means extending at least partially around the doorway and having an upper inlet and a lower outlet.

6. The stove of claim 5 wherein the doorway is tubular and forms the draft tube means.

* * * * *